US008678574B2

(12) United States Patent
Adachi

(10) Patent No.: US 8,678,574 B2
(45) Date of Patent: Mar. 25, 2014

(54) PRINTING APPARATUS

(71) Applicant: Canon Kabushiki Kaisha, Tokyo (JP)

(72) Inventor: Eiichi Adachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/785,773

(22) Filed: Mar. 5, 2013

(65) Prior Publication Data

US 2013/0235130 A1 Sep. 12, 2013

(30) Foreign Application Priority Data

Mar. 9, 2012 (JP) ..... 2012-052746
Feb. 14, 2013 (JP) ..... 2013-026871

(51) Int. Cl.
*B41J 2/175* (2006.01)

(52) U.S. Cl.
USPC ..... 347/86

(58) Field of Classification Search
USPC ..... 347/84–86
See application file for complete search history.

(56) References Cited

U.S. PATENT DOCUMENTS

| | | | | |
|---|---|---|---|---|
| 7,354,144 | B2 * | 4/2008 | Hatasa et al. | 347/86 |
| 7,934,822 | B2 * | 5/2011 | Miyazawa et al. | 347/86 |
| 8,454,137 | B2 * | 6/2013 | Price et al. | 347/85 |
| 8,485,642 | B2 * | 7/2013 | Hayashi et al. | 347/86 |

FOREIGN PATENT DOCUMENTS

JP 11-157094 A 6/1999

* cited by examiner

*Primary Examiner* — Kristal Feggins
(74) *Attorney, Agent, or Firm* — Fitzpatrick, Cella, Harper & Scinto

(57) ABSTRACT

A printing apparatus is provided with an ink tank mounting portion for mounting an ink tank, the ink tank mounting portion being capable of mounting a first ink tank and a second ink tank shorter in length than the first ink tank. The ink tank mounting portion includes an operation lever provided with a first pressing portion for pressing the first ink tank in the mounting direction at the time of mounting the first ink tank and a second pressing portion for pressing the second ink tank in the mounting direction at the time of mounting the second ink tank. By operating the operation lever, the pressing portion for pressing the ink tank to be mounted is switched between the first pressing portion and the second pressing portion depending on whether the ink tank to be mounted is the first ink tank or the second ink tank.

9 Claims, 10 Drawing Sheets

PRINTING APPARATUS

BACKGROUND OF THE INVENTION

1. Field of the Invention

The present invention relates to a printing apparatus, and particularly to a printing apparatus which is removable and replaceable ink tanks differing in size.

2. Description of the Related Art

An inkjet printing apparatus used in a print medium in a large size adopts a system in which ink tanks are accommodated in a tank holder arranged in a main body of the printing apparatus and inks are supplied to print heads through ink supplying tubes. The reason for adoption of the above system is that, in the inkjet printing apparatus used in the print medium in a large size, because of a large use amount of inks and a large number of colors of inks, a total weight of the apparatus becomes large when the ink tank is mounted to a carriage, therefore requiring output of a drive motor to be large. In addition, the reason for adoption of the above system is that, the reaction of the carriage becomes large because of a heavy weight of the carriage, thereby making it difficult to improve a print quality.

In such a printing apparatus in which the tank holder is installed in the main body of the printing apparatus to accommodate the ink tanks therein, there are some cases where, since an insert/pullout force of a joint needle portion arranged in either one of the ink tank and the main body is large, it is difficult to remove and replace the ink tank.

On the other hand, there is known a printing apparatus provided with a mechanism for removing and replacing the ink tank by a lever operation using the principle of leverage (refer to Japanese Patent Laid-Open No. H11-157094 (1999)).

In a case of adopting the inkjet printing apparatus adapted for the ink tank having a large capacity, there are some cases where a user has a demand for use of an ink tank having a small capacity less expensive than the ink tank having the large capacity, depending on use frequency of the printing apparatus or the like. In addition, in a case where a user stores ink tanks each having a small capacity for the other type to some extent, the user possibly has a demand for use of the stored ink tank having the small capacity.

In the mechanism for removing and replacing the ink tank by the lever operation using the principle of leverage, a part of the lever makes contact with the ink tank with rotation of the lever to press the ink tank inside. Accordingly, in a case of using ink tanks differing in shape, there is a possibility that in the mechanism for removing and replacing the ink tank with the lever operation using the principle of leverage, the removal operation of the ink tank differing in shape, particularly due to a low height can not be performed.

On the other hand, there is a method in which an adaptor is mounted to an ink tank having a small capacity, which makes a tank overall size equal to that of a regular ink tank. In this method, however, since it is necessary for a user to mount the adaptor to the ink tank, the operation becomes troublesome for the user. In a case where the user loses or damages the adaptor, the ink tank having the small capacity can not be mounted.

SUMMARY OF THE INVENTION

The present invention is made in view of the foregoing problems, and an object of the present invention is to provide, also in a case of mounting an ink tank smaller in size than a regular ink tank to an ink tank mounting portion, a printing apparatus capable of mounting the smaller ink tank without mounting an adaptor thereon. Therefore according to the present invention, a printing apparatus comprising an ink tank mounting portion for mounting an ink tank accommodating ink therein, the ink tank mounting portion being capable of mounting a first ink tank and a second ink tank shorter in length in the mounting direction to be mounted to the ink tank mounting portion than the first ink tank, wherein the ink tank mounting portion includes an operation lever provided with a first pressing portion for pressing the first ink tank in the mounting direction at the time of mounting the first ink tank and a second pressing portion for pressing the second ink tank in the mounting direction at the time of mounting the second ink tank, wherein by operating the operation lever, the pressing portion for pressing the ink tank to be mounted is switched between the first pressing portion and the second pressing portion depending on whether the ink tank to be mounted is the first ink tank or the second ink tank.

Further features of the present invention will become apparent from the following description of exemplary embodiments (with reference to the attached drawings).

DESCRIPTION OF THE EMBODIMENTS

Hereinafter, embodiments according to the present invention will be in detail explained with reference to the accompanying drawings.

(First Embodiment)

Figure 1:
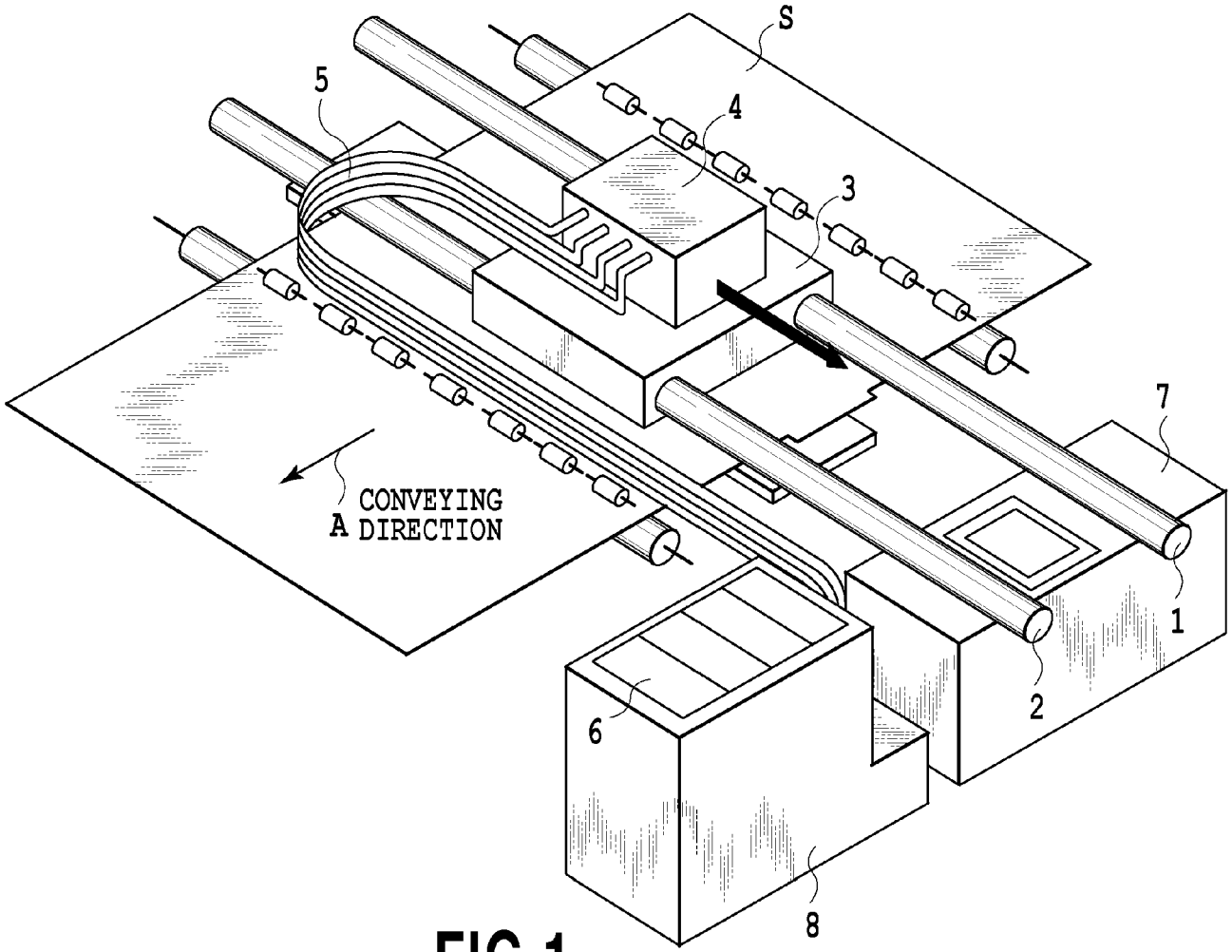
FIG. 1 is a schematic perspective view showing an entirety of an inkjet printing apparatus according to a first embodiment of the present invention.

FIG. 1 is a schematic perspective view showing an entirety of an inkjet printing apparatus according to the present embodiment. The inkjet printing apparatus includes a guide rail 1 and a sub rail 2, and a carriage 3 can move along the guide rail 1 and the sub rail 2 in a direction perpendicular to the conveying direction A of a print medium S by a drive mechanism (not shown). The carriage 3 is provided with print heads 4 for ejecting inks of different colors. The print heads 4 are connected through ink supplying tubes 5 for supplying inks and an ink tank mounting portion 8 to ink tanks 6 for accommodating the inks therein.

At a printing operation, the carriage 3 moves in a print region, and in the meanwhile, the print head 4 ejects ink toward the print medium S to perform printing. For filling the print head 4 with the ink, a recovery unit 7 is used to perform a suction operation, thereby generating a negative pressure in an inside of the print head 4 and in an inside of the ink supplying tube 5 to suck out the ink from the ink tank 6.

Next, the ink tank mounting portion 8 will be in detail described.

Figure 2A:
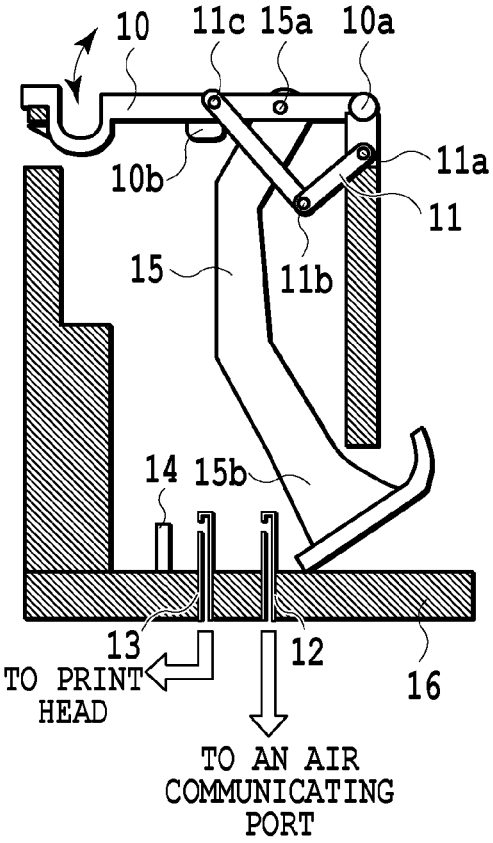
FIG. 2A and FIG. 2B are schematic cross sections each showing an ink tank mounting portion according to the first embodiment.
Figure 2B:
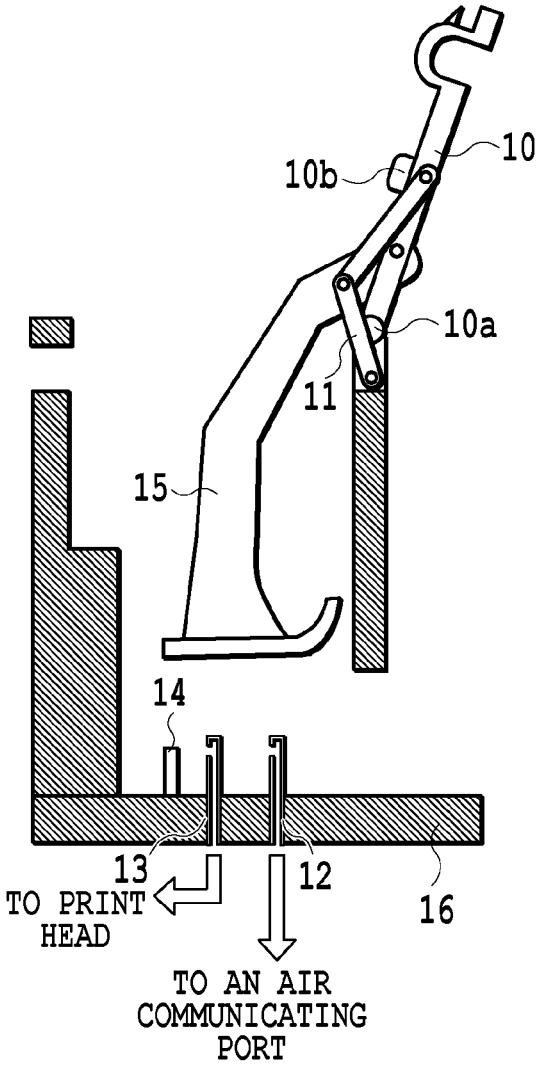

FIG. 2A and FIG. 2B are schematic cross sections each showing the ink tank mounting portion 8 according to the present embodiment. FIG. 2A shows a state where an operation lever 10 is closed without mounting an ink tank to ink tank mounting portion 8, and FIG. 2B shows a state where the operation lever 10 is opened without mounting the ink tank thereto.

When the operation lever 10 provided with a first pressing portion 10*b* rotates around an operation lever rotary shaft 10*a*, a second pressing portion 11 moves through link joints 11*a* to 11*c* as the connecting portions to the operation lever 10 and a tank release arm 15 provided with a tank release cam 15*b* moves through a rotary shaft 15*a* as the connecting portion to the operation lever 10. A supply base 16 is provided with an air communicating needle 12 and an ink supplying needle 13, which are communicated through joint portions of the ink tank with an inside of the ink tank. The air communicating needle 12 is communicated through an air communicating port (not shown) with an atmosphere, and introduces air into the inside of the ink tank corresponding to an amount for the ink in the inside of the ink tank to be supplied. The ink supplying needle 13 is communicated through the ink supplying tube 5 with the print head 4, to which ink is supplied from the ink tank corresponding to an amount of the ejected ink. The supply base 16 is provided with a reading sensor 14, with which the main body of the printing apparatus can read color information and ink remaining information stored in an IC chip mounted to the ink tank. In the present invention, "an ink tank is mounted to an ink tank mounting portion" mean "an ink tank and an ink tank mounting portion is communicated". For instance, the ink tank is connected to the ink tank mounting portion. In FIG. 2A and FIG. 2B, the air communicating needle 12 and the ink supplying needle 13 is installed in the joint portions, so the ink tank is mounted to the ink tank mounting portion.

FIG. 3A to FIG. 3F are schematic cross sections showing the process in which a first ink tank 101 is mounted to the ink tank mounting portion 8 according to the present embodiment. The ink tank mounting portion 8 according to the present embodiment can mount two kinds of ink tanks of the first ink tank and a second ink tank smaller in size than the first ink tank. Herein an explanation will be made of the mounting process of the first ink tank, but also in a case of mounting the second ink tank, an operation method of the operation lever 10 by a user is the same as that of the first ink tank.

Figure 3A:
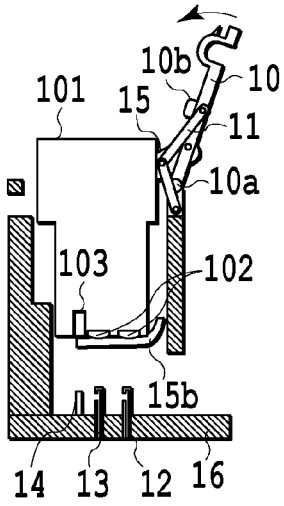
FIG. 3A to FIG. 3F are diagrams showing the process in which a first ink tank is mounted to the ink tank mounting portion according to the first embodiment.
Figure 3B:
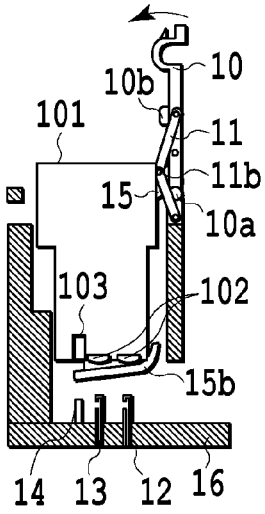

As shown in FIG. 3A, the first ink tank 101 is mounted to the ink tank mounting portion 8 in the mounting direction, and the operation lever 10 is rotated in an arrow direction as shown in the figure. Then, since the tank release arm 15 is connected to the operation lever 10 by the rotary shaft 15*a*, the tank release arm 15 is lowered with rotation of the operation lever 10. As a result, as shown in FIG. 3B, the first ink tank 101 moves downward, which creates a state where the link joint 11*b* of the second pressing portion 11 makes contact with the first ink tank 101.

Figure 3C:
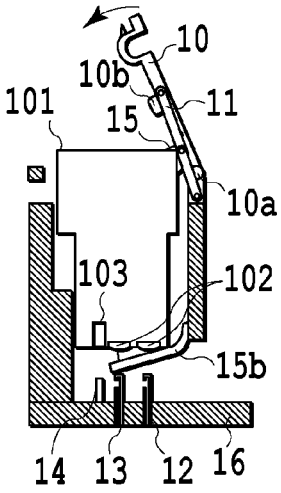

When the operation lever 10 is further rotated in this state, the link joints 11*a* to 11*c* of the second pressing portion 11, as shown in FIG. 3C, line up linearly.

Figure 3D:
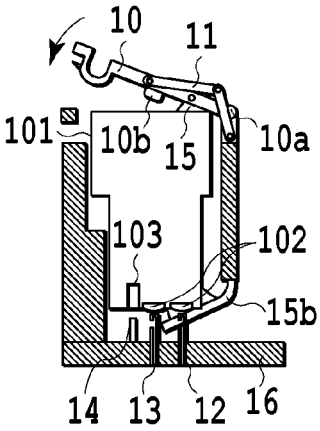
Figure 3E:
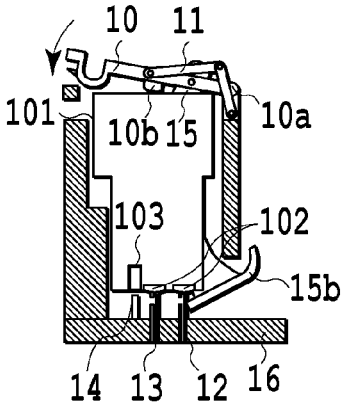
Figure 3F:
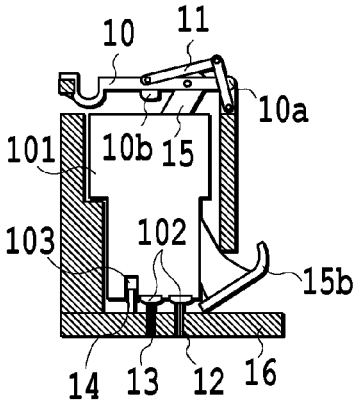
Figure 4A:
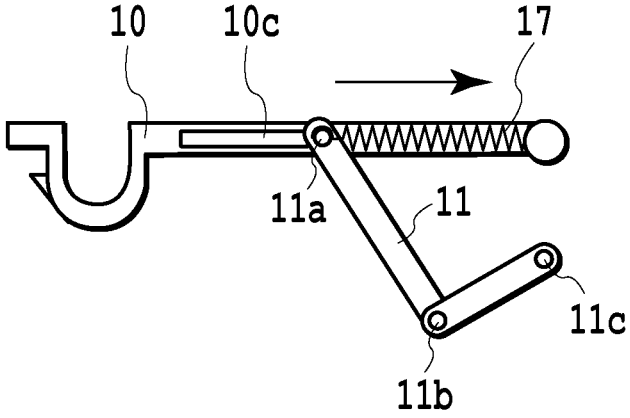
FIG. 4A to FIG. 4C are schematic diagrams showing an operation of an operation lever and a second pressing portion in FIG. 3A to FIG. 3F.
Figure 4B:
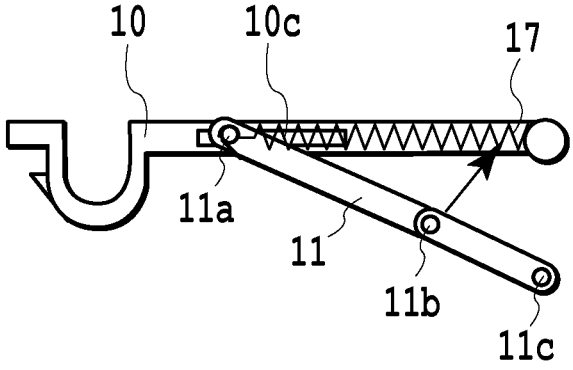
Figure 4C:
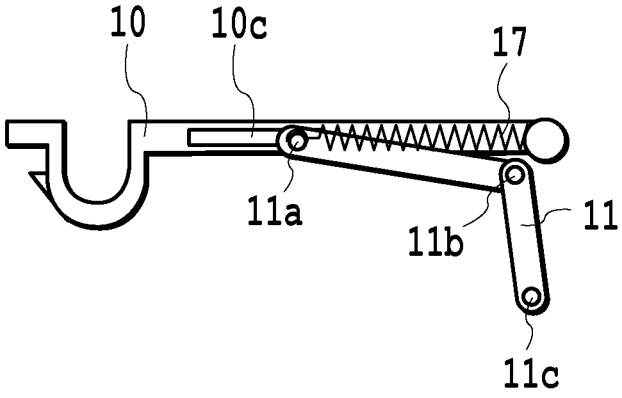

FIG. 4A to FIG. 4C are schematic diagrams explaining the operation of the operation lever 10 and the second pressing portion 11 in the ink tank mounting portion 8 in FIG. 3A to FIG. 3F. As shown in FIG. 4A, the second pressing portion 11 is provided with a tension spring 17 a force of which acts in an arrow direction as shown in the figure and has the toggle structure that the link joint 11*a* is movable along a groove 10*c* formed in the operation lever 10. Therefore when the link joint 11*c* moves in an arrow direction from a neutral state as shown in FIG. 4B, as shown in FIG. 4C the link joint 11*b* is bent in a reverse side to FIG. 4A.

That is, when the operation lever 10 further rotates from the state in FIG. 3C, as shown in FIG. 3D the second pressing portion 11 is curved in a reverse direction to the inner direction of the ink tank mounting portion 8, the second pressing portion 11 moves to a position of not making contact with the first ink tank 101. The first ink tank 101 goes down without making contact with the second pressing portion 11. Finally a joint rubber 102 positioned in the bottom surface of the first ink tank 101 is in a state of being in contact with the air communicating needle 12 and the ink supplying needle 13.

The joint rubber 102 is provided with a slit. A pressing force is applied to the first ink tank 101 to some extent for the air communicating needle 12 and the ink supplying needle 13 to push and enlarge the slit of the joint rubber 102 for insert. Accordingly the sealing property between the air communicating needle 12 and the ink supplying needle 13, and the joint rubber 102 can be maintained to establish the communication between the inside of the ink tank 101 and the main body of the printing apparatus. Therefore since the pressing force is not applied to the first ink tank 101 in the state shown in FIG. 3D, the joint rubber 102 does not stick to the air communicating needle 12 and the ink supplying needle 13.

When the operation lever 10 is further rotated, as shown in FIG. 3E the tank release arm 15 following the rotation is separated from the bottom surface of the first ink tank 101, and the first pressing portion 10*b* provided in the operation lever 10 is in contact with an upper surface of the first ink tank 101. When this state occurs, the pressing force can be applied through the first pressing portion 10*b* to the first ink tank 101. By rotating the operation lever 10 as it is, the air communicating needle 12 and the ink supplying needle 13 are pressed into the slit portion of the joint rubber 102, and the operation lever 10 reaches to the ink tank mounting state shown in FIG. 3F.

Along with it, a printing chip 103 provided in the bottom surface of the first ink tank 101 is connected to the reading sensor 14 provided in the supply base 16, and therefore the main body of the printing apparatus can read color information and ink remaining information stored in the printing chip 103.

Figure 5A:
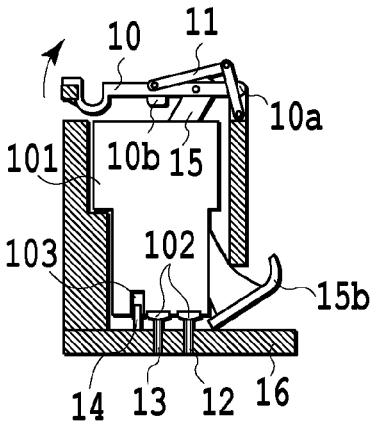
FIG. 5A to FIG. 5F are diagrams showing the process in which the first ink tank is removed from the ink tank mounting portion according to the first embodiment.
Figure 5B:
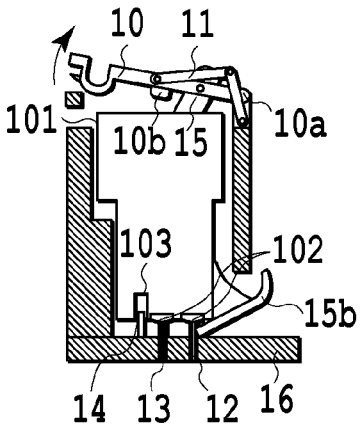
Figure 5C:
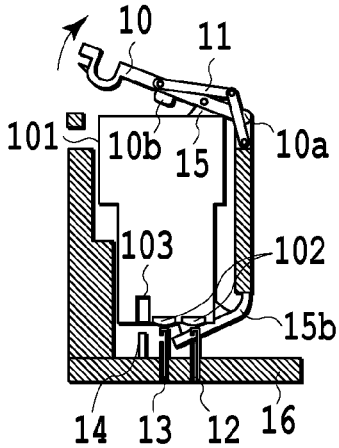
Figure 5D:
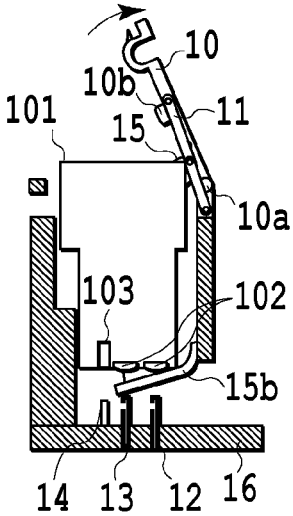
Figure 5E:
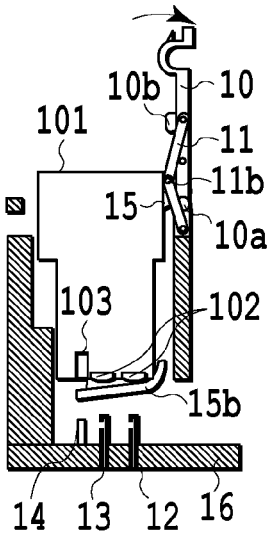
Figure 5F:
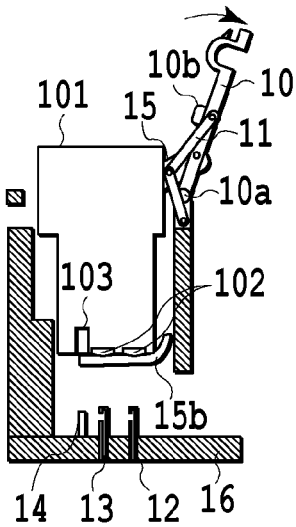

FIG. 5A to FIG. 5F are schematic cross sections showing the process in which the first ink tank 101 is removed from the ink tank mounting portion 8 according to the present embodiment. As shown in FIG. 5A, the operation lever 10 is rotated in an arrow direction from the mounting state of the first ink tank 101. Then, as shown in FIG. 5B, the first pressing portion 10*b* is separated from the first ink tank 101, and the tank release arm 15 makes contact with the bottom surface of the first ink tank 101. As the operation lever 10 is further rotated from this state, as shown in FIG. 5C the tank release arm 15 is lifted with the rotation of the operation lever 10, and the first ink tank 101 is also lifted together with it. When the operation lever 10 is further rotated in the arrow direction as it is, the first ink tank 101 is lifted in the order of FIG. 5D to FIG. 5F, and the first ink tank 101 becomes in a state capable of being removed from the main body of the printing apparatus by a user. In addition, in the process of FIG. 5D to FIG. 5F the second pressing portion 11 is returned to the original posture by the toggle mechanism described above.

Next, an explanation will be made of an operation at the time of removing and replacing a second ink tank 201 smaller than the first ink tank 101, that is, shorter in length of the mounting direction to be mounted in the ink tank mounting portion than the first ink tank.

FIG. 6A to FIG. 6F are schematic cross sections showing the process in which the second ink tank 201 is mounted to and is removed from the ink tank mounting portion 8 according to the present embodiment.

Figure 6A:
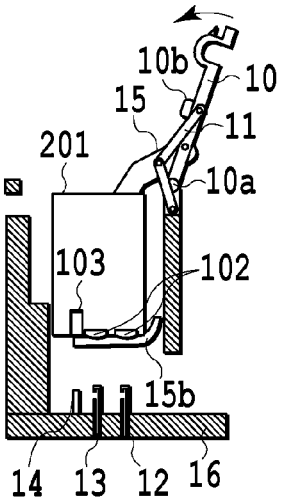
FIG. 6A to FIG. 6F are diagrams showing the process in which a second ink tank is mounted to and is removed from the ink tank mounting portion according to the first embodiment.

As shown in FIG. 6A, the second ink tank 201 is a shorter tank in the depth direction of the ink tank mounting portion 8, that is, in the length in the mounting direction than the first ink tank 101. The second ink tank 201 is provided with the joint rubber 102 and the printing chip 103 as similar to the first ink tank 101.

When the operation lever 10 is further rotated in an arrow direction in the figure, the second ink tank 201 is lowered following the rotation of the operation lever 10 as similar to a case at the time of mounting the aforementioned first ink tank 101. At this time, while the second ink tank 201 moves downward as shown in FIG. 6B, the link joint 11*b* of the second pressing portion 11 does not make contact with the second ink tank 201.

Figure 6B:
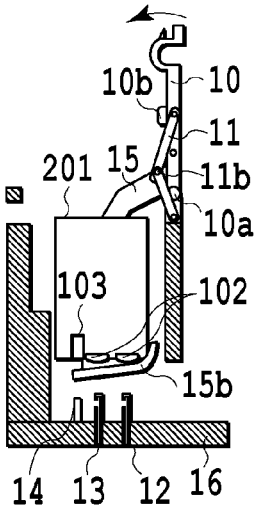
Figure 6C:
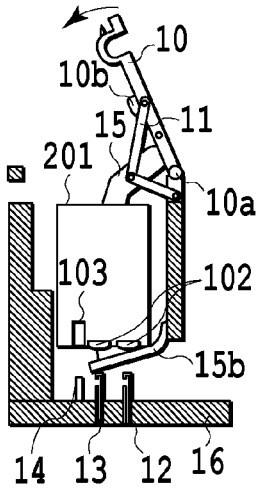
Figure 6D:
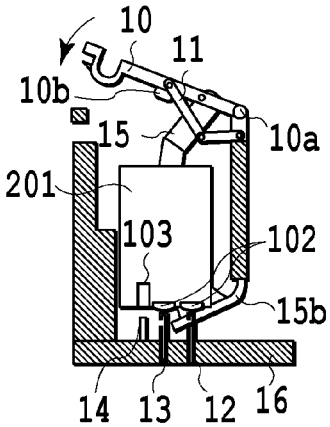

Therefore as shown in FIG. 6B to FIG. 6D, even if the operation lever 10 is rotated, the link joints 11*a* to 11*c* of the second pressing portion 11, which are different from a case of mounting the first ink tank 101, do not line up linearly. Further, a connecting part between the operation lever 10 and the second pressing portion 11 is provided with a cam mechanism (not shown). As the operation lever 10 is further rotated from a state of FIG. 6D, the link joint 11*a* as shown in FIG. 4A to FIG. 4C is configured not to move to the operation lever 10. As a result, the second pressing portion 11, even if the operation lever 10 is rotated, remains in a state where the link joint 11*b* is bent in the reverse direction to a case of mounting the first ink tank, that is, in the inner direction of the ink tank mounting portion 8.

Figure 6E:
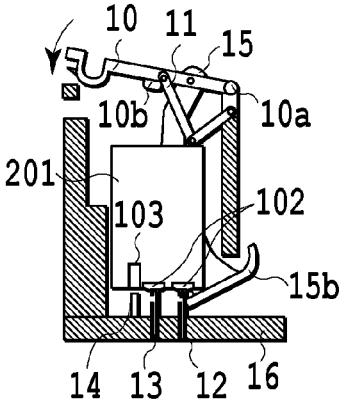
Figure 6F:
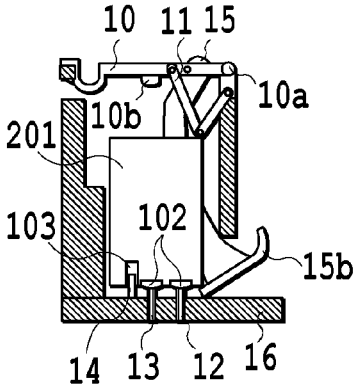

When the operation lever 10 is further rotated, as shown in FIG. 6E to FIG. 6F the vicinity of the link joint 11*b* of the second pressing portion 11 gets in contact with the second ink tank 201. At this time, the link joint 11*a* does not move to the operation lever 10 as mentioned before, and the posture of the second pressing portion 11 remains as it is. Therefore with the rotation of the operation lever 10, the pressing force is applied through the second pressing portion 11 to the second ink tank 201, and the second ink tank 201 arrives at the ink tank mounting state.

In addition, in a case of removing the second ink tank 201 from the ink tank mounting portion 8, by rotating the operation lever 10 in the reverse process to a case of mounting it, that is, in the order as shown in FIG. 6F to FIG. 6A, the second ink tank 201 can be removed from the main body of the printing apparatus.

As described above, when the operation lever 10 is rotated in a case of mounting the first ink tank 101 to the ink tank mounting portion 8, since the link joint 11*b* of the second pressing portion 11 makes contact with the first ink tank 101, the link joint 11*a* to the link joint 11*c* line up in a straight line. In addition, when the operation lever 10 is further rotated, the first ink tank 101 is pressed by the first pressing portion 10*b* to be lowered without being in contact with the second pressing portion 11. On the other hand, when the operation lever 10 is rotated in a case of mounting the second ink tank 201 to the ink tank mounting portion 8, the link joint 11*b* of the second pressing portion 11 does not make contact with the second ink tank 201, and the link joint 11*c* of the second pressing portion 11 is bent in the inner direction of the ink tank mounting portion 8. As a result, the second ink tank 201 is pressed by the second pressing portion 11 to be lowered.

As describe above, by operating the operation lever, the pressing portion for pressing the ink tank to be mounted is switched between the first pressing portion and the second pressing portion, depending on whether the ink tank to be mounted is the first ink tank or the second ink tank. In addition, in a case where the ink tank is small, the second pressing portion 11 presses the ink tank. As a result, either the first ink tank or the second ink tank lower in height than the first ink tank is removing and replacing, a user can mount the ink tank to the main body only by similarly rotating the operation lever 10.

That is, even in a case of mounting an ink tank differing in size to the ink tank mounting portion, the ink tank can be mounted without using the adaptor.

It should be noted that the printing apparatus according to the present embodiment adopts the inkjet printing apparatus, but the present invention may be applied to any printing apparatus for performing printing by using ink.

(Second Embodiment)

In the first embodiment, at the time of mounting the second ink tank, the link joint of the second pressing portion 11 is bent in the inner direction of the ink tank mounting portion with the rotation of the operation lever to press the ink tank. In an ink tank mounting portion according to the present embodiment, however, when an operation lever rotates, a pressing guide slides to press a second ink tank.

Figure 7A:
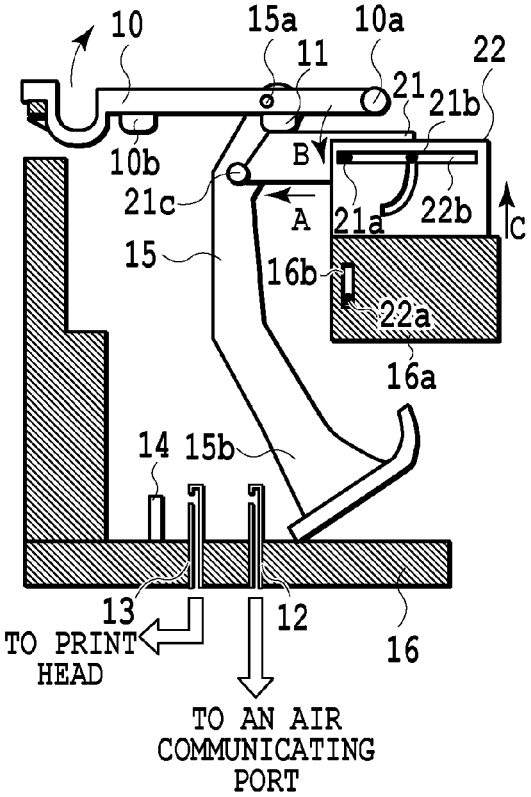
FIG. 7A and FIG. 7B are schematic cross sections each showing an ink tank mounting portion according to a second embodiment.
Figure 7B:
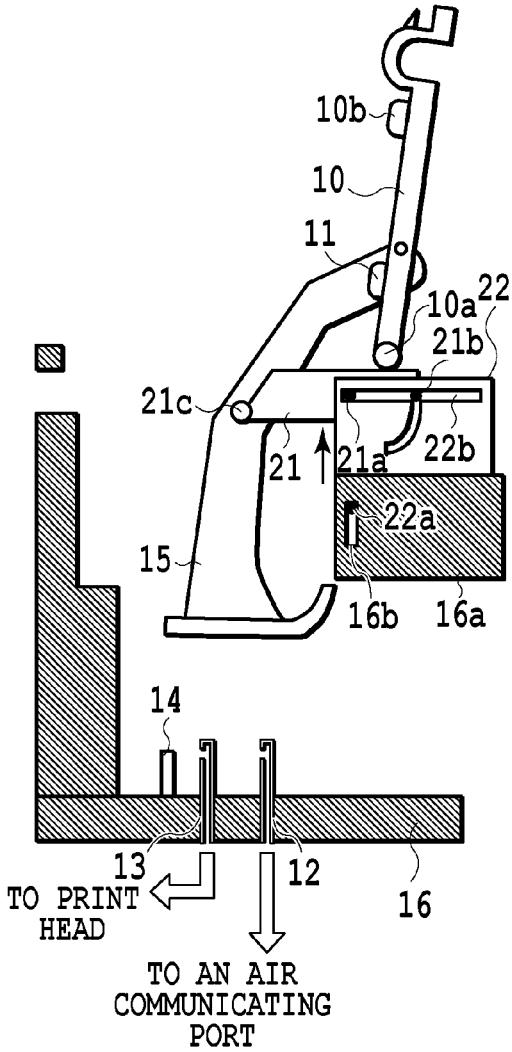

FIG. 7A and FIG. 7B are schematic cross sections showing an ink tank mounting portion 8 according to the present embodiment. FIG. 7A shows a state where an operation lever 10 is closed without mounting the ink tank to the ink tank mounting portion 8, and FIG. 7B shows a state where the operation lever 10 is opened without mounting the ink tank thereto. A pressing guide (first pressing portion) 21 is retained in a direct operated guide 22, and a pressing guide rotary shaft 21*a* can move in a direction along a pressing guide groove 22*b*. The pressing guide 21 is urged in an arrow A direction shown in the figure by a spring mechanism (not shown). The pressing guide 21 can rotate in a state where the pressing guide rotary shaft 21*a* is in contact with the left end of the pressing guide groove 22*b*, and is urged in an arrow B direction in the figure. At this time, since a pressing guide rotation stopper 21*b* is in contact with the pressing guide groove 22*b*, the pressing guide 21 can not rotate in the arrow direction from a state of the figure.

The direct operated guide 22 is retained by a direct operated guide retaining portion 16*a* of the supply base 16, and a direct operated guide shaft 22*a* can move in a direction along a direct operated guide groove 16*b*. In addition, the direct operated guide 22 is urged in an arrow C direction shown in the figure by a spring mechanism (not shown). On the other hand, in a state where the operation lever 10 is closed as shown in FIG. 7A, since an upper surface of the pressing guide 21 makes contact with the second pressing portion 11, the direct operated guide shaft 22*a* is retained in a state of being not in contact with an upper end surface of the direct operated guide groove 16*b*.

As shown in FIG. 7B, when the operation lever 10 is rotated, since the second pressing portion 11 is separated from the upper surface of the pressing guide 21, as shown in FIG. 7B the direct operated guide 22 moves together with the pressing guide 21 to a position where the direct operated guide shaft 22*a* makes contact with the upper end of the direct operated guide groove 16*b*.

Next, hereinafter, an explanation will be made of an operation at the time the ink tank is mounted to and removed from the ink tank mounting portion 8.

Figure 8A:
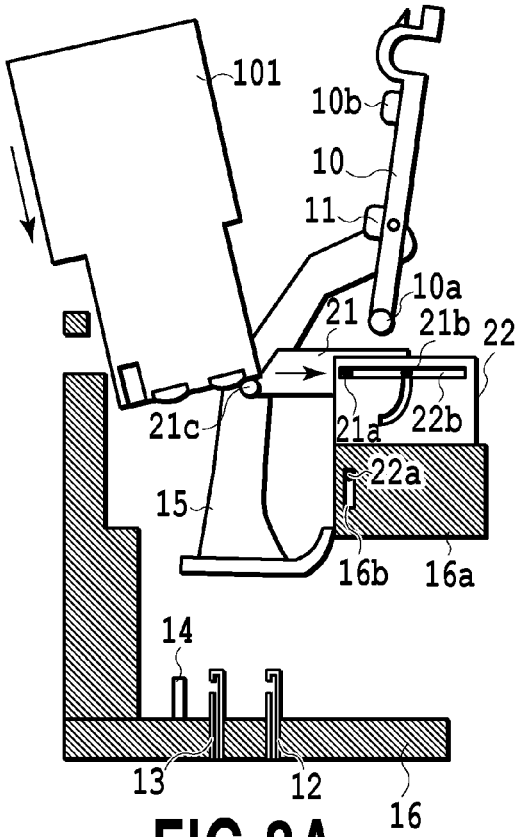
FIG. 8A to FIG. 8D are diagrams showing the process in which a first ink tank is mounted to the ink tank mounting portion according to the second embodiment.
Figure 8B:
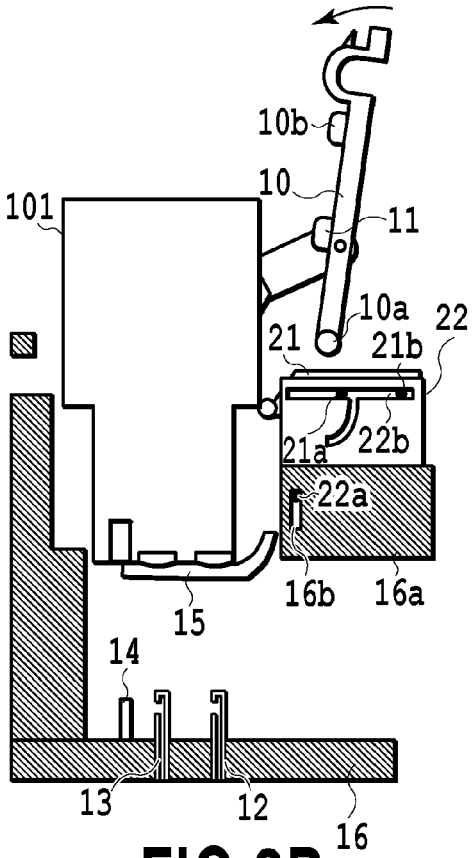

FIG. 8A to FIG. 8D are schematic cross sections showing the process in which the first ink tank 101 is mounted to the ink tank mounting portion 8 according to the present embodiment. As shown in FIG. 8A, when a user mounts the first ink tank 101 to the ink tank mounting portion 8, the pressing guide 21 is pressed to a surface in a vertical direction to a surface which the first ink tank 101 presses, and moves in an arrow direction shown in the figure. When the user further presses the first ink tank 101 as it is, the first ink tank 101 becomes in a state where a guide roller 21*c* of the pressing guide 21 is in contact with a side face of the first ink tank 101, and also becomes in a state of being placed on the tank release arm 15. When the operation lever 10 is rotated in an arrow direction shown in the figure from this state, the tank release arm 15 is lowered with the rotation of the operation lever 10, and the first ink tank 101 is also lowered.

Figure 8C:
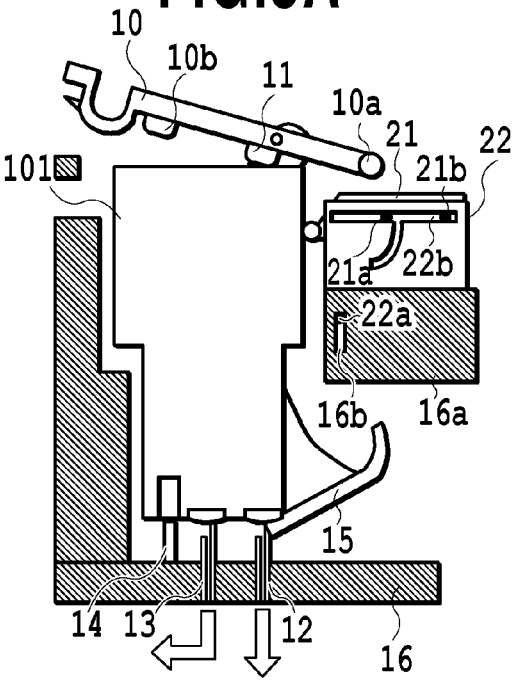

When the operation lever 10 is further rotated, as shown in FIG. 8C the joint rubber 102 positioned in the bottom surface of the first ink tank 101 makes contact with the air communicating needle 12 and the ink supplying needle 13. In addition, the tank release arm 15 is separated from the bottom surface of the first ink tank 101. At this time, the second pressing portion 11 provided in the operation lever 10 makes contact with the upper surface of the first ink tank 101. When this state occurs, the pressing force can be applied through the second pressing portion 11 to the first ink tank 101. When the operation lever 10 is rotated as it is, the other first pressing portion 10*b* also makes contact with the first ink tank 101 next to the second pressing portion 11 to apply the pressing force to the first ink tank 101. As a result, the first ink tank 101 becomes in the ink tank mounting state shown in FIG. 8D.

Figure 8D:
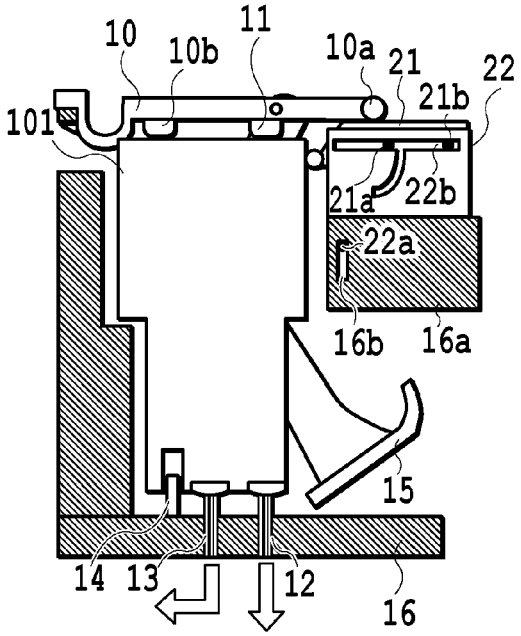

In addition, in a case of removing the first ink tank 101 from the ink tank mounting portion 8, the first ink tank 101 can be removed from the main body of the printing apparatus by rotating the operation lever 10 in the reverse process to a case of mounting the first ink tank 101, that is, in the order shown in FIG. 8D to FIG. 8A.

FIG. 9A to FIG. 9D are schematic cross sections showing the process in which the second ink tank 201 is mounted to the ink tank mounting portion 8 according to the present embodiment.

Figure 9A:
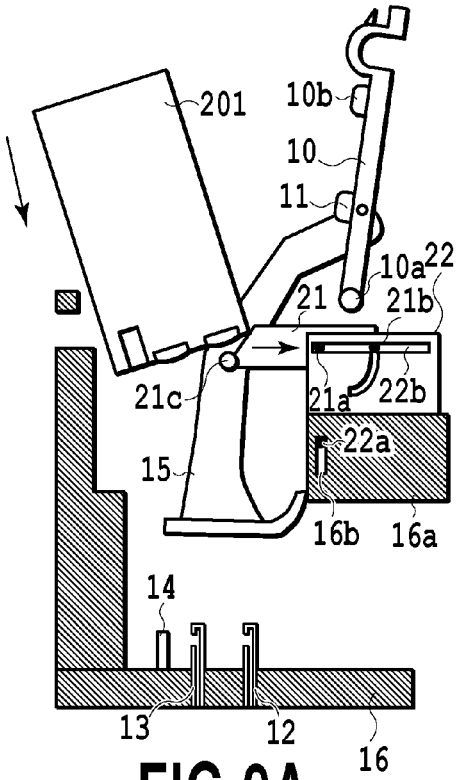
FIG. 9A to FIG. 9D are diagrams showing the process in which a second ink tank is mounted to the ink tank mounting portion according to the second embodiment.
Figure 9B:
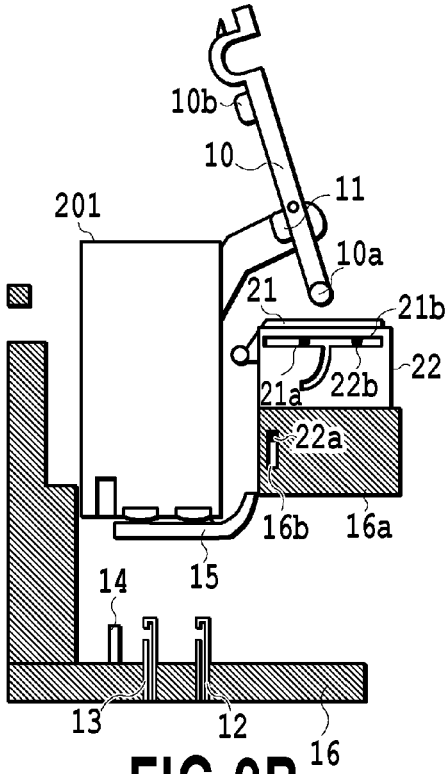
Figure 9C:
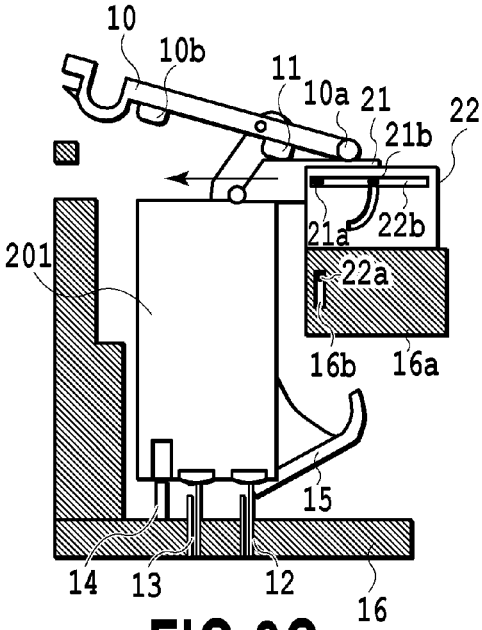

The second ink tank 201 has a shorter length in the mounting direction to be mounted to the ink tank mounting portion 8 than the first ink tank 101. As shown in FIG. 9A and FIG. 9B, when the second ink tank 201 is mounted to the ink tank mounting portion 8, as similar to a case of mounting the first ink tank 101, the second ink tank 201 becomes in a state where the guide roller 21*c* of the pressing guide 21 is in contact with a side face of the second ink tank 201, and also becomes in a state of being placed on the tank release arm 15. The second ink tank 201 has a shorter length in the mounting direction to be mounted to the ink tank mounting portion 8 than the first ink tank 101. Therefore when the operation lever 10 is rotated from this state, as shown in FIG. 9C the second ink tank 201 is lowered, the pressing guide 21 moves in an arrow direction shown in the figure by a spring, and enters in between the operation lever 10 and the second ink tank 201.

Figure 9D:
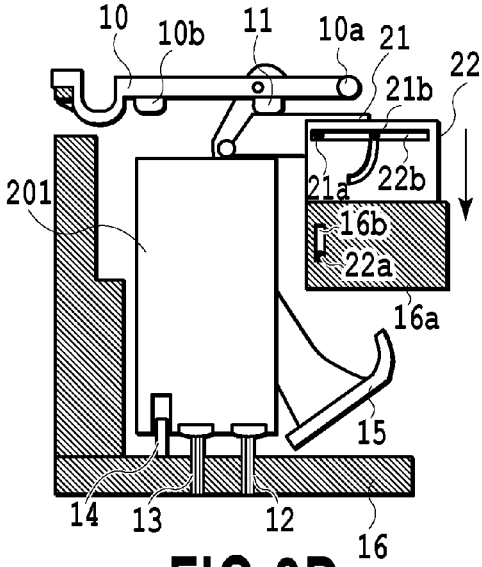

When the operation lever 10 is further rotated, as shown in FIG. 9D since the pressing guide 21 is pressed by the second pressing portion 11, the direct operated guide 22 together with the pressing guide 21 are lowered in an arrow direction shown in the figure, and the pressing force is applied to the second ink tank 201 to be in the mounting state.

Figure 10A:
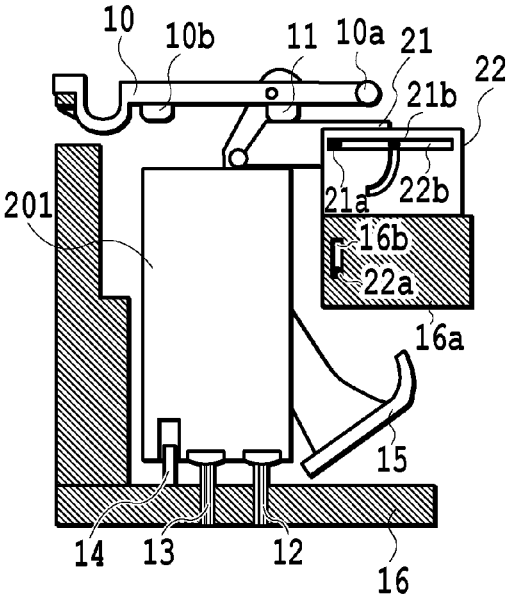
FIG. 10A to FIG. 10D are diagrams showing the process in which the second ink tank is mounted to and is removed from the ink tank mounting portion according to the second embodiment.
Figure 10B:
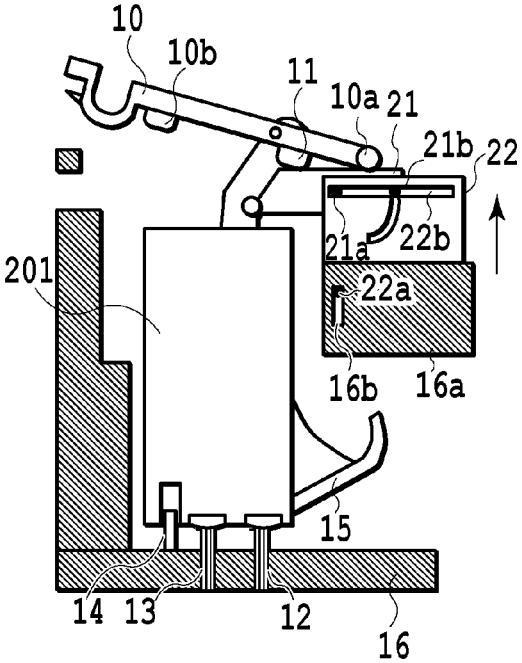
Figure 10C:
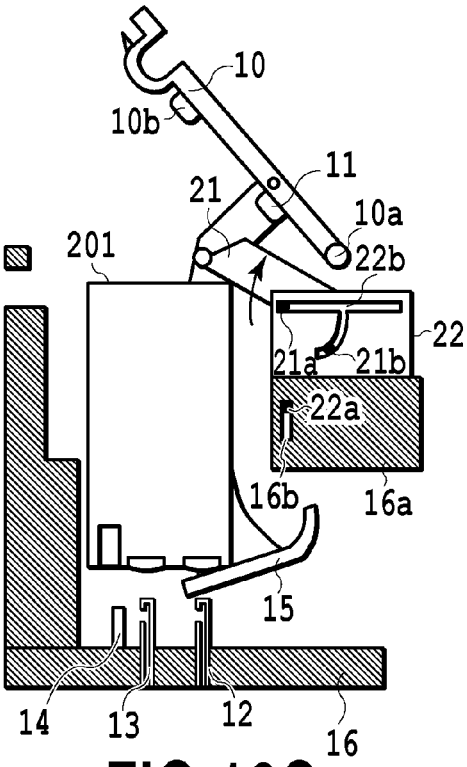
Figure 10D:
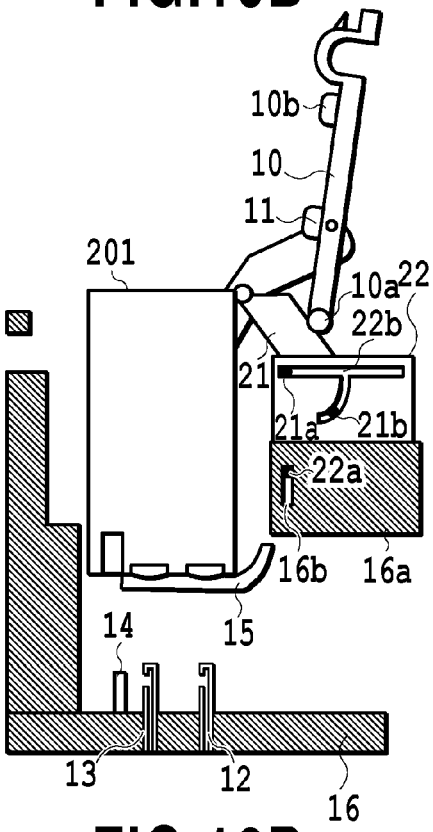

FIG. 10A to FIG. 10D are schematic cross sections showing the process in which the second ink tank 201 is removed from the ink tank mounting portion 8 according to the present embodiment. Since a gap is formed between the tank release arm 15 and the second ink tank 201 in the mounting state shown in FIG. 10A, even if the operation lever 10 is rotated, the second ink tank 201 does not move. On the other hand, the second pressing portion 11 is separated from the pressing guide 21 with the rotation of the operation lever 10. Therefore as shown in FIG. 10B, since the direct operated guide 22 is urged by a spring, the direct operated guide 22 moves together with the pressing guide 21 until the direct operated guide shaft 22*a* makes contact with the upper end of the direct operated guide groove 16*b*. When the operation lever 10 is further rotated, the second ink tank 201 is lifted with a rise of the tank release arm 15. As shown in FIG. 10C, since the pressing guide 21 is rotatable around the pressing guide rotary shaft 21*a* in an arrow direction shown in the figure, the pressing guide 21 rotates with a rise of the tank. When the operation lever 10 is rotated as it is, the operation lever 10 becomes in a state shown in FIG. 10D, and the second ink tank 201 can be removed.

In this way, also in a case of mounting the ink tank differing in size to the ink tank mounting portion, the ink tank can be mounted without using the adaptor.

According to the above configuration, when the first ink tank is mounted, the ink tank is pressed by the first pressing portion, and when the second ink tank is mounted, the ink tank is pressed by the second pressing portion. As a result, also in a case of mounting two kinds of ink tanks differing in size to the ink tank mounting portion, the ink tank can be mounted without the other adaptor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-052746, filed Mar. 9, 2012, 2013-026871, filed Feb. 14, 2013 which are hereby incorporated by reference herein in their entirety.

What is claimed is:

1. A printing apparatus comprising an ink tank mounting portion for mounting an ink tank storage ink therein, the ink tank mounting portion being capable of mounting a first ink tank and a second ink tank shorter in length in the mounting direction to be mounted to the ink tank mounting portion than the first ink tank, wherein the ink tank mounting portion includes an operation lever provided with a first pressing portion for pressing the first ink tank in the mounting direction at the time of mounting the first ink tank and a second pressing portion for pressing the second ink tank in the mounting direction at the time of mounting the second ink tank, wherein by operating the operation lever, the pressing portion for pressing the ink tank to be mounted is switched between the first pressing portion and the second pressing portion depending on whether the ink tank to be mounted is the first ink tank or the second ink tank.

2. A printing apparatus according to claim 1, wherein at the time of mounting the first ink tank, the first pressing portion makes contact with the first ink tank with rotation of the operation lever to press the first ink tank.

3. A printing apparatus according to claim 1, wherein at the time of mounting the second ink tank, the second pressing portion makes contact with the second ink tank with rotation of the operation lever to press the second ink tank.

4. A printing apparatus according to claim 3, wherein at the time the second pressing portion makes contact with the second ink tank to press the second ink tank, the second pressing portion is bent in the inner direction of the ink tank mounting portion.

5. A printing apparatus according to claim 1, wherein at the time of mounting the first ink tank, the second pressing portion moves to a position of not making contact with the first ink tank with rotation of the operation lever.

6. A printing apparatus according to claim 1, wherein the second pressing portion includes a plurality of connecting portions.

7. A printing apparatus according to claim 6, wherein at the time of mounting the first ink tank, with rotation of the operation lever the plurality of connecting portions change from a state of being bent in the inner direction of the ink tank mounting portion to a state of linearly lining up.

8. A printing apparatus according to claim 7, wherein in a state where the plurality of connecting portions linearly line up, with further rotation of the operation lever the plurality of connecting portions changes into a state of not lining up linearly.

9. A printing apparatus according to claim 1, wherein at the time of mounting the second ink tank, even if the operation lever is rotated, the first pressing portion does not make contact with the second ink tank.

* * * * *